United States Patent [19]

Grothe

[11] Patent Number: 4,612,970

[45] Date of Patent: Sep. 23, 1986

[54] GUIDING DEVICE FOR AN OSCILLATING CONTINUOUS CASTING MOLD

[75] Inventor: Horst Grothe, Kaarst, Fed. Rep. of Germany

[73] Assignee: SMS Schloemann-Siemag AG, Dusseldorf, Fed. Rep. of Germany

[21] Appl. No.: 697,278

[22] Filed: Feb. 1, 1985

[30] Foreign Application Priority Data

Feb. 2, 1984 [DE] Fed. Rep. of Germany ..... 3403598

[51] Int. Cl.[4] ..... B22D 11/12

[52] U.S. Cl. ..... 164/416; 164/478

[58] Field of Search ..... 164/71.1, 260, 261, 164/412, 416, 478; 72/710

[56] References Cited

U.S. PATENT DOCUMENTS

| | | | |
|---|---|---|---|
| 3,386,494 | 6/1968 | Yearly et al. | 164/416 |
| 3,662,813 | 5/1972 | Stull | 164/260 |
| 4,057,099 | 11/1977 | Danielli | 164/416 |
| 4,480,678 | 11/1984 | Cazaux et al. | 164/416 |

FOREIGN PATENT DOCUMENTS

| | | | |
|---|---|---|---|
| 554126 | 1/1960 | Belgium . | |
| 620172 | 11/1962 | Belgium . | |
| 0006783 | 1/1980 | European Pat. Off. | 164/416 |
| 0032116 | 1/1981 | European Pat. Off. . | |
| 2248066 | 4/1974 | Fed. Rep. of Germany . | |
| 2108878 | 5/1983 | United Kingdom . | |

*Primary Examiner*—Nicholas P. Godici
*Assistant Examiner*—Richard K. Seidel
*Attorney, Agent, or Firm*—Karl F. Ross; Herbert Dubno

[57] ABSTRACT

A guiding device for an oscillating continuous casting mold includes a spring holder connected at a central area to a frame of a continuous casting plant, and a spring which is clamped in a bridge-like manner at its both extremities to the spring holder and is connected to the mold lifting platform via an intermediary part.

14 Claims, 3 Drawing Figures

GUIDING DEVICE FOR AN OSCILLATING CONTINUOUS CASTING MOLD

FIELD OF THE INVENTION

My present invention relates to oscillating continuous casting molds and, more particularly, to a guiding device for an oscillating continuous casting mold.

BACKGROUND OF THE INVENTION

In general, guiding devices over which the present invention is an improvement are used for oscillating continuous casting molds having a frame and a lifting platform which is provided with lateral supports connected to a frame via resilient elements.

From the Europatent application No. E-A 0 032 116 published July 15, 1981, a guiding device is known which has a set of round spring rods provided with a centered bulge. The spring rods are individually clamped between respective blocks arranged on a support platform which is bolted at its circumference to a stationary frame. The bulge is clamped between holding bars for the mold lifting platform or table.

This guiding device is rather cumbersome in its structural design but also does not provide a sufficiently constant guiding accuracy even upon careful adjustment because of uneven thermal expansions of the round rods which do not provide a sufficient lateral guidance. Moreover, these round rods are prone to corrosion.

OBJECTS OF THE INVENTION

It is the principal object of the present invention to provide an improved guiding device for an oscillating continuous casting mold obviating the afore-stated drawbacks.

Another object of this invention is to provide an improved continuous casting mold assembly with better oscillation guidance and freedom of the guide means from corrosion.

SUMMARY OF THE INVENTION

I realize this object, according to the invention, by providing a spring holder which is connected at a central area of a frame of the continuous casting assembly and a spring, preferably a leaf spring which is supported by the end portions of the spring holder in a bridge-like manner and which is fixed to a central area of the mold lifting platform. The central areas referred to may be in a vertical median plane through the apparatus to opposite sides of the mold, two such guide units being disposed symmetrically with respect to a vertical plane perpendicular to the aforementioned plane.

For biasing the spring, the latter is provided with reinforced extremities which define with the aligned end portions of the spring holder respective recesses into which clamping means are inserted.

The clamping means can include two wedges which are inserted into the respective recess such that their tapered surfaces lie closely against each other.

For connecting the spring holder to the frame, fastening means are provided including a pedestal arranged at a central location of the frame and having an upper surface onto which a respective projection of the spring holder is fixed. The upper surface of the pedestal is inclined so that the spring holder as well as the spring is inclined in such a manner that the unit of spring holder and spring are aligned along an axis which extends along or is tangent to the arc of a curved continuous casting strand and thus perpendicular to the radius of curvature of the arc. The guide device and most advantageously the spring lie along or parellel to a radius of this arc.

The connection between the spring and the mold lifting platform can be made also via an intermediary part which is fixed with one end portion to the platform at a central location thereof and can be connected with its other end portion to the spring via a fit screw.

In order to protect the device against corrosion and heat radiation, the spring holder and the spring are surrounded by a trough and a lid closing the trough into which preferably a corrosion-resistant fluid is introduced.

The guiding device according to the invention is thus very compact in its structure as well as easy to control and provides a continuous accuracy of guiding. Apart from the achieved reliability in operation, the unit of spring holder and spring is easy to replace.

BRIEF DESCRIPTION OF THE DRAWING

The above and other objects, advantages and features of my present invention will now be described in detail with reference to the accompanying drawing in which.

SPECIFIC DESCRIPTION

Figure 1:
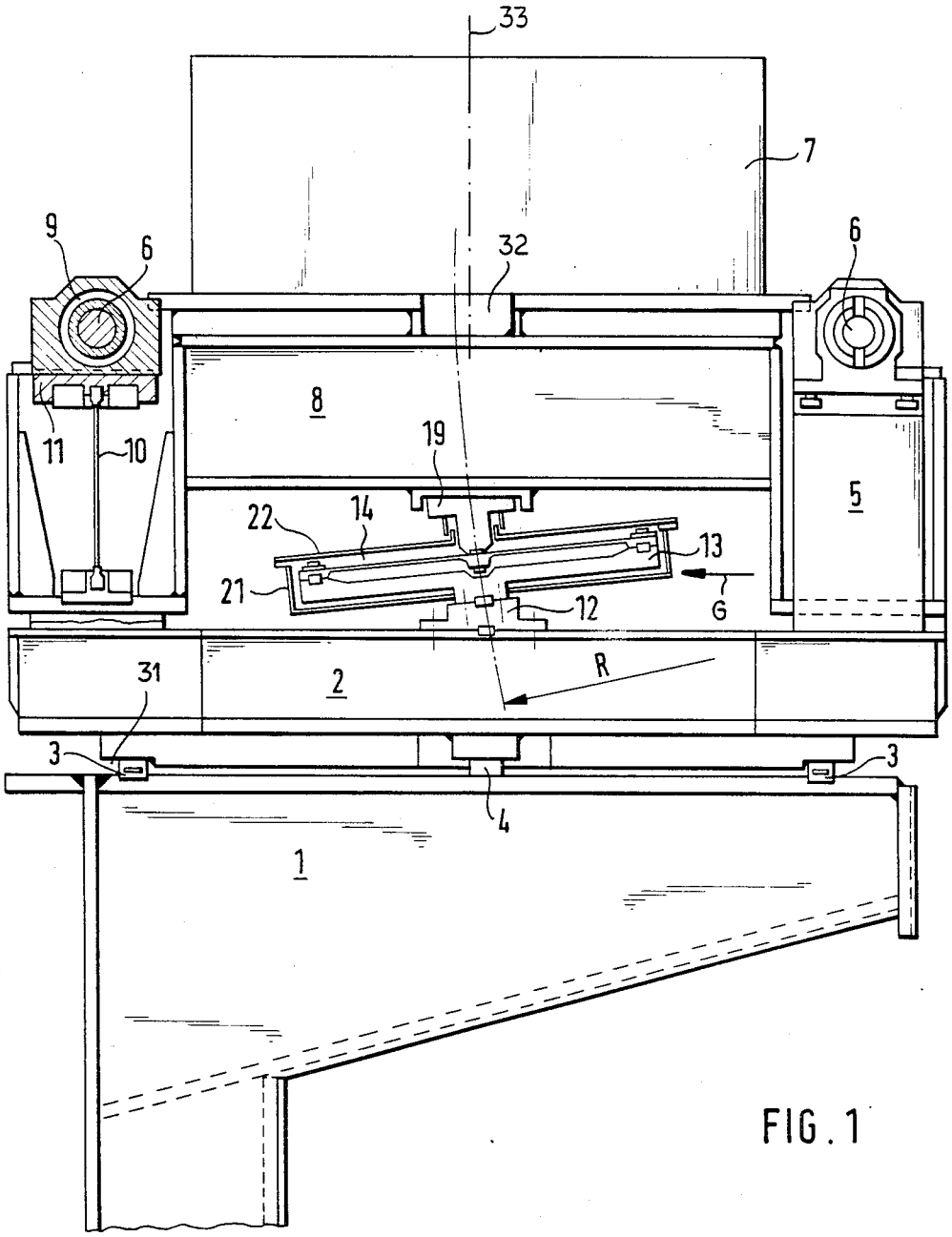
FIG. 1 is a partly sectional view of a continuous casting mold provided with a guiding device according to the invention.

Referring firstly to FIG. 1, there is shown a continuous casting plant including a base frame 1, a changing frame 2, a mold lifting platform 8 and a continuous casting mold 7.

The base frame 1 supports the changing frame 2 by means of spacer blocks 3 and a respective centering bolt 4 which is welded to the changing frame 2 at the center of each of a pair of opposite limbs of the frame.

The spacer blocks 3 are fitted at opposing sides in the base frame 1 and project in associated grooves 31 provided at a distance to each other at the side of the changing frame 2 facing the base frame 1.

Arranged at a distance to each other, the changing frame 2 is provided with upright supports 5 serving as bearings for driven eccentric shafts 6 which cooperate with eccentrics 9. For transmitting the oscillating motion provided by the eccentrics 9 of the eccentric shafts 6 to the mold lifting platform 8, the latter is suspended from bearings 11 of the eccentrics 9 at four locations by means of leaf springs 10. The lifting platform 8 supports the mold 7 via a centering block 32 so that the oscillating motion is simultaneously transmitted to the mold 7. This type of drive for oscillating the mold is found in the Europatent application.

In order to allow an exact guidance of the oscillating lifting platform 8 in direction of the mold axis 33, a guiding device is provided between the changing frame 2 and the lifting platform 8. The guiding device generally characterized by reference numeral G includes a spring holder 13 which at its center has a projection 13*a* fixed to a pedestal 12 via e.g. screw connections (indicated by dash-dot lines 34). The pedestal 12 is fixed to the changing frame 2 e.g. by screw connections (indicated by dash-dot lines 35). In addition, the pedestal 12 and the spring holder 13 are kept in position to each other via fitting pieces 36*a*, 36*b*. One such guide assembly is provided at each of these opposite limbs in a vertical median plane through the frames, i.e., a plane of the axis 33 perpendicular to the plane of the paper in FIG. 1.

Figure 2:
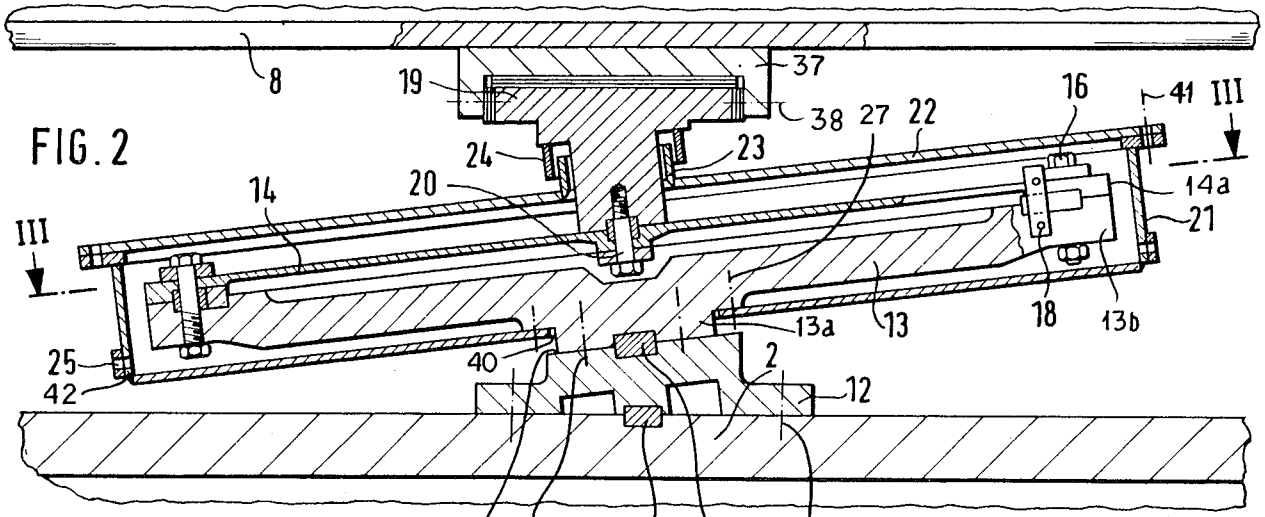
FIG. 2 is a cross sectional view on an enlarged scale of the guiding device taken along line II—II in FIG. 3.
Figure 3:
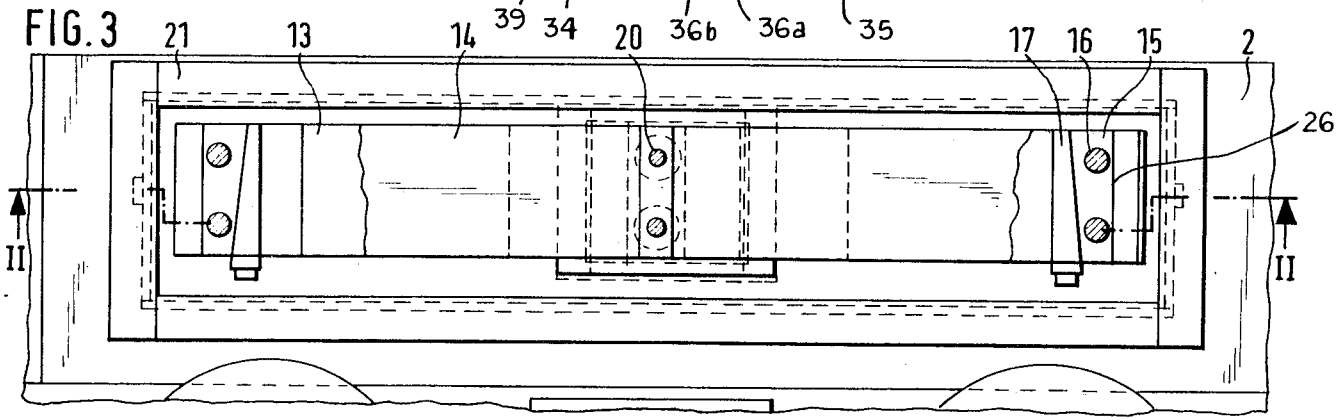
FIG. 3 is a partly sectional top view of the guiding device along line III—III in FIG. 2.

As can be especially seen from FIG. 2, the spring holder 13 is provided with raised end portions 13*b* to fix at these ends a leaf spring 14 in a bridge-like manner which is reinforced at its extremities 14*a* facing the end portions 13*b*. The extremities 14*a* of the leaf spring 14 and the end portions 13*b* of the holder 13 define recesses 26 in which wedges 15 are inserted to bias the leaf spring 14. Each wedge 15 is fixed to the associated extremity 14*a* and associated end portion 13*b* by means of screws 16. In each recess 26, a clamping wedge 17 is further inserted such that its tapered surface sits close along the tapered surface of the wedge 15. Via a bracket 18, each clamping wedge 17 is fixed to the spring carrier 13.

Welded to the underside of the lifting platform 8 is an inverted U-shaped member 37 which received a step-shaped intermediary part 19. The upper portion of the intermediary part 19 projects into the recess defined by the U-shape of the member 37 and is connected thereto e.g. by screw connections (indicated by dash-dot lines 38) while its lower portion is supported by the leaf spring 14 and fixed thereto via a fit screw 20.

As can be seen from FIGS. 1 and 2, the socket 12 has an inclined upper surface 39 so that the guiding device G and thus the spring holder 13 and the leaf spring 14 are also inclined at an angle relative to the respective horizontal axis. Consequently, in the arc type casting plant with thus arc-shaped guidance of billets, the inclination of the guiding device G is adapted to the radius R of the arc-shaped guidance of billets i.e. that the arrangement and fixation of the pedestal 12, spring holder 13, leaf spring 14, intermediary part 19 is adapted to the radius of the arc type casting plant in order to obtain an alignment of the guiding device G (see especially FIG. 1). In this case the axis of the guide device is tangential to a circle of the radius R or lies in the arc.

For protecting the guiding device G against corrosion and heat radiation, the spring holder 13 and the leaf spring 14 is embedded in a trough 21. At its bottom portion, the trough 21 is provided with a cutout 40 for allowing the projection 13*a* of the spring holder 13 to extend therethrough and to be attached to the pedestal 12. Adjacent to the projection 13*a*, the trough 21 is connected to the spring holder 13 by screw connections (indicated by dash-dot lines 27). The trough 21 is further provided with openings 25 at its lower front and rear ends which openings communicate with respective connecting sockets 42 to allow introduction of grease or oil from a not-shown fluid source into the interior of the trough 21. Via e.g. a screw connection (indicated by dash-dot lines 41), the trough 21 is closable by a lid 22 which is provided with a pipe socket 23 surrounding the lower portion of the intermediary part 19. The pipe socket 23 cooperates telescopically with a second pipe socket 24 of larger diameter and which is connected to the intermediary part 19.

By means of the leaf spring 14 and the telescopic arrangement of the pipe sockets 23 and 24, the guiding device G can precisely follow the oscillating motion of the lifting platform 8 and the mold 7.

I claim:

1. In a continuous casting apparatus including an oscillating mold, a mold lifting platform and a frame,
   a guiding device, said guiding device comprising:
   a spring holder having two end portions;
   first fastening means for connecting said spring holder to the frame;
   a spring having two extremities each of which being clamped to the aligned one of said end portions so that said spring bridges said spring holder; and
   second fastening means for connecting said spring to the mold lifting platform.

2. A device as defined in claim 1 wherein said spring is a leaf spring.

3. A device as defined in claim 1, further comprising clamping means for biasing said spring, each of said extremities being reinforced and cooperating with the aligned one of said end portions of said spring holder such that a recess is defined therebetween, said clamping means being arranged within each of said recesses.

4. A device as defined in claim 3 wherein said clamping means includes a first wedge inserted into each of said recesses and being connected with the respective one of said extremities and the respective one of said end portions; and a second wedge inserted into each of said recesses and being connected to said spring holder.

5. A device as defined in claim 4 wherein said first and said second wedges each has a tapered surface, the tapered surface of said second wedge being closely aligned with the tapered surface of said first wedge when being arranged within said recesses.

6. A device as defined in claim 1 wherein said second fastening means includes an intermediary part having one portion connected to the lifting platform at its central area and another portion fixed to said spring.

7. A device as defined in claim 1 wherein said first fastening means includes a pedestal fixed to the frame at its central area and having an upper surface, said spring holder having a projection which is fixed to said upper surface of said pedestal.

8. A device as defined in claim 6 wherein said upper surface of said pedestal is inclined so that said spring holder and said spring are inclined at an angle with respect to a horizontal axis.

9. A device as defined in claim 7, and further comprising a trough fixed to said spring holder; and a lid arranged on said trough to close the latter, said spring holder and said spring being surrounded by said trough and said lid.

10. A device as defined in claim 9 wherein said lid is provided with a pipe socket, said intermediary part having a further pipe socket cooperating with said pipe socket of said lid in such a manner that a telescopic arrangement therebetween is obtained.

11. A device as defined in claim 9 wherein said trough is in communication with a fluid source so as to allow introduction of fluid into said trough.

12. A device as defined in claim 11 wherein said fluid is oil.

13. A device as defined in claim 11 wherein said fluid is grease.

14. A continuous casting installation comprising:
   a frame having two pairs of opposing limbs;
   a mold carrying platform above said frame;
   means for oscillating said platform on said frame; and
   guide means for guiding the movement of said platform on said frame, said guide means including:
   a respective bridge connected to a respective limb of said frame of one of said pairs, and
   a respective leaf spring spanning each of said bridges and connected to said platform.

* * * * *